US006068240A

United States Patent [19]

Leveugle

[11] Patent Number: 6,068,240

[45] Date of Patent: May 30, 2000

[54] METHOD FOR REGULATING THE OPERATION OF A LOAD COMPENSATION DEVICE AND LOAD COMPENSATION USING THE METHOD

[75] Inventor: Jean Leveugle, Lyons, France

[73] Assignee: Reel SA, France

[21] Appl. No.: 08/922,563

[22] Filed: Sep. 3, 1997

[30] Foreign Application Priority Data

Sep. 10, 1996 [FR] France ..... 9611236

[51] Int. Cl.[7] ..... B66D 1/00

[52] U.S. Cl. ..... 254/277; 254/325

[58] Field of Search ..... 254/266, 270, 254/273, 274, 277, 323, 325, 334, 392

[56] References Cited

U.S. PATENT DOCUMENTS

| | | | |
|---|---|---|---|
| 4,126,298 | 11/1978 | Lub | 254/277 |
| 4,724,970 | 2/1988 | Kuhn | 254/277 X |
| 4,759,256 | 7/1988 | Kovit et al. | 254/277 X |
| 5,044,608 | 9/1991 | Hidaka et al. | 254/266 |
| 5,102,102 | 4/1992 | Hidaka et al. | 254/266 |

FOREIGN PATENT DOCUMENTS

| | | | |
|---|---|---|---|
| 0080679 | 6/1983 | European Pat. Off. . | |
| 0292413 | 11/1988 | European Pat. Off. . | |
| 2008529 | 6/1979 | United Kingdom | 254/274 |
| 2055488 | 3/1981 | United Kingdom . | |

*Primary Examiner*—Donald P. Walsh
*Assistant Examiner*—Emmanuel M. Marcelo
*Attorney, Agent, or Firm*—Parkhurst & Wendel, L.L.P.

[57] ABSTRACT

A method and apparatus for regulating a load compensator device for a handling gear. The load compensation device includes: a stationary internal bell housing; a mobile external bell housing which is secured at one of the ends of a handling member, from the other end of which the load is hung; and an overload pneumatic cylinder and an underload pneumatic cylinder connected to a pressure source and/or exhausted by a series of electric directional control valves. The pressure is controlled within the cylinders continuously to alter the datum position of the external bell housing that corresponds to the state of equilibrium, function of the variations in pressure which are measured at the cylinders. Changes in pressure cancels out any overload or underload effect on the load and returns the load compensator to its state of equilibrium that corresponds to the handling gear in its initial state of equilibrium.

4 Claims, 2 Drawing Sheets

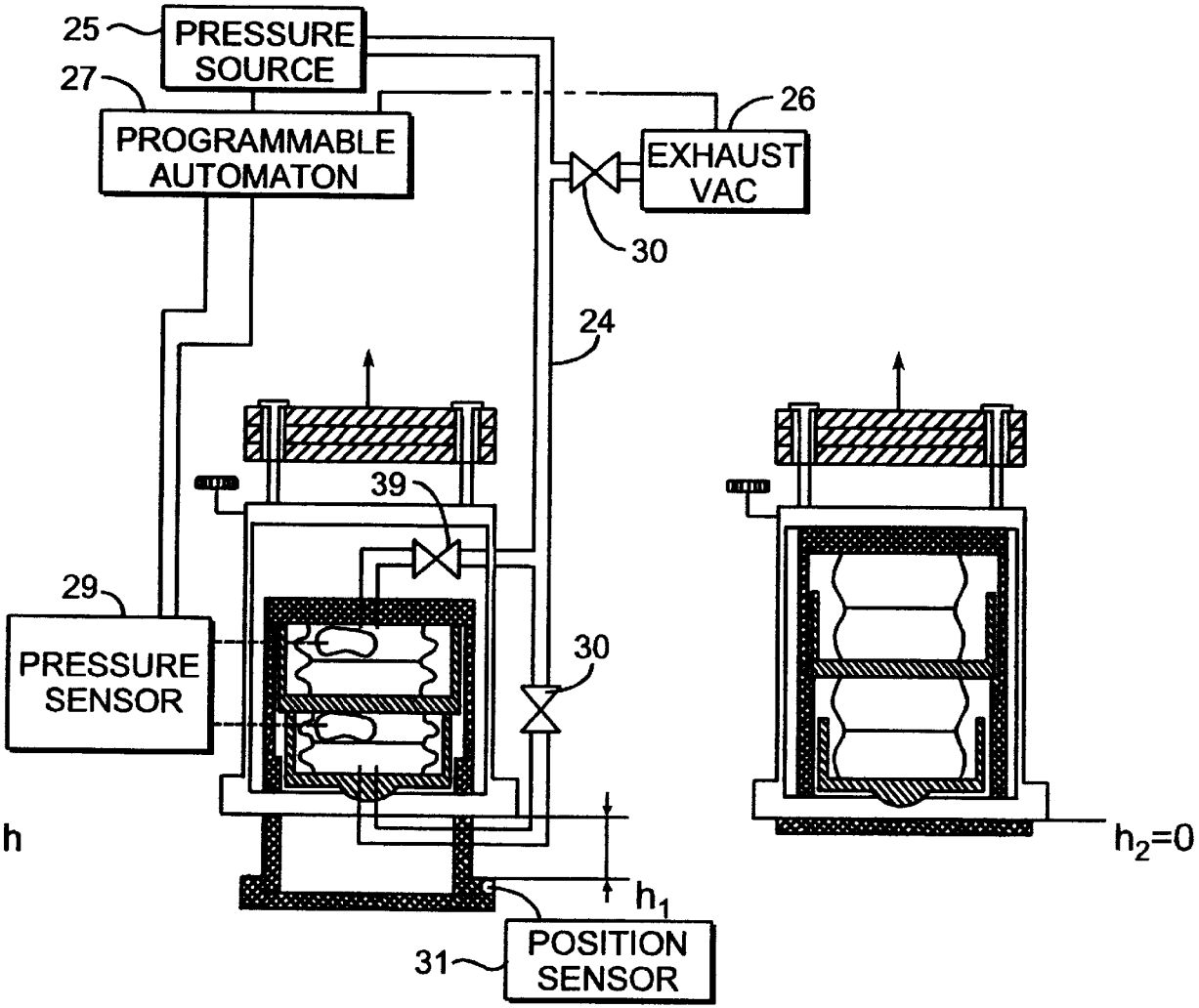
FIG. 4
FIG. 3
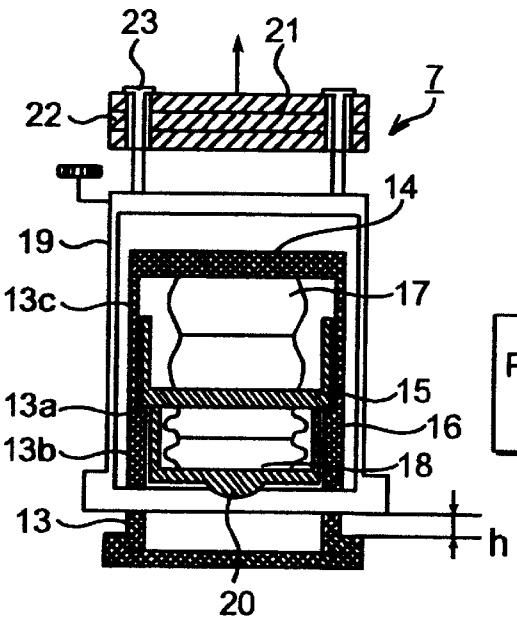
FIG. 2

METHOD FOR REGULATING THE OPERATION OF A LOAD COMPENSATION DEVICE AND LOAD COMPENSATION USING THE METHOD

BACKGROUND OF THE INVENTION

The invention deals, in general, with lifting gear and more particularly with the use of such lifting gear in sensitive environments, such as the reactors of nuclear power stations. More specifically, the invention relates to a method for regulating the operation of a load compensation device for such handling gear, as well as to the load compensator that uses this method.

Although the invention will be more specifically described in conjunction with its application to the nuclear industry, it will be clearly understood that its scope is not limited thereto.

The core of the reactor in a nuclear power station consists, as is known, of a certain number of nuclear fuel assemblies put in place at a transverse bearer or core plate at the bottom of the reactor vessel.

These fuel assemblies can be handled independently of one another given that, after a certain amount of irradiation time, the irradiated fuel assemblies need either to be replaced or to be positioned differently within the core in order to make the radiation of energy in the bottom of the core uniform.

These fuel assemblies are handled using a handling machine, also known as a refuelling machine, capable of moving in a horizontal plane above the pool that covers the reactor core, the machine being equipped with an operating truck also capable of moving in another horizontal direction within the machine.

The truck in fact comprises lifting gear which usually consists of a vertical telescopic mast that can be unfolded, at the end of which there is a gripper capable of engaging with the upper end of the nuclear fuel assemblies. The telescopic mast can be moved in the vertical direction by a lifting means which usually consists of a motorized winch, on the winch drum of which a cable or chain or any equivalent member is wound and which somewhere within the system comprises one or more return pulleys.

Generally speaking, nuclear fuel assemblies consist of rods comprising sintered pellets of actual fuel, and joined together by means of spacer grids distributed along the height of the assembly.

Given that the various nuclear fuel assemblies are positioned side by side in the core plate, and come into contact with one another, especially at the spacer grids, it has been observed that the assemblies become snagged at the grids, especially during operations of lifting or of fitting assemblies with respect to neighbouring assemblies.

In the context of a lifting operation, that is to say the removal or repositioning of a fuel assembly, this snagging results in overloading at the lifting gear, especially overloading of the cable, and this overload needs to be detected immediately so that the refuelling machine winch motor can be stopped.

The reason for this is that, assuming such an overload were not to be detected, or, assuming it were to take too long for the winch motor to be stopped, the grids of the snagged assemblies would be liable to sustain damage and there would be a risk that the cohesion of the assembly itself would suffer.

The same phenomenon occurs when a fuel assembly is being inserted into the core, the only difference here being that the overload this time is underload, which means that the tension in the cable or in the chain is reduced, with the result that the fuel assembly is no longer necessarily positioned vertically.

In order to alleviate this severe drawback, a load compensator intended to be positioned at the truck of the refuelling machine has been proposed, for example in document EP-B-0,292,413 in the name of the Applicant.

Such a device fundamentally comprises:

- a stationary frame secured to the truck and comprising two end stops;
- a slider intended to slide in the frame between these end stops;
- an outer bell housing provided with means capable of cooperating with the slider;
- an overload cylinder arranged between the slider and the frame, especially one of the end stops;
- an underload cylinder arranged between the slider and the outer bell housing.

The end of the cable or of the chain of the lifting gear is fixed directly or indirectly to the outer bell housing.

Furthermore, an electro-pneumatic circuit for modulating the supply to the cylinders is provided, and acts as a function of the variations in load.

These variations in load are detected by means of a load cell which, as a function of previously determined and set thresholds, brings about the pressurizing of the underload cylinder and/or overload cylinder, respectively, by discrete amounts.

Although these pre-established and therefore fixed pressures do indeed compensate for the positive or negative variations in load, it has, however, also been observed that bearing in mind the lack of control over the effective movement of the cable, the sum of the actions to which the fuel assembly being handled is subjected, namely the movement which caused it to snag and the reverse movement brought about by the compensator, leads to an absolute displacement of the fuel assembly in the opposite direction to the initial movement.

It has now been established that the fuel assemblies that coexist within one and the same core may be of different types and makes and that, in particular, the locations of the spacer grids in each of the assemblies differs and may therefore cause undercontrolled snagging in the opposite direction, precisely because the absolute displacement of the fuel assembly being handled is in the opposite direction from the initial movement.

Furthermore, it has become evident that bearing in mind the speed with which the compensator moves, a relative movement between fuel assemblies is brought about, and the instantaneous speed of this movement is higher than the speed allowed for handling these assemblies.

It has consequently seemed essential to employ precise control over the operation of the compensator, especially to eliminate any reverse movement of the fuel assembly being handled.

SUMMARY OF THE INVENTION

The purpose of the invention is therefore to propose a method of regulating the operation of such a load compensation device capable of avoiding this reverse absolute movement of the load after it has been brought into use.

This method of regulating the operation of a load compensation device for handling gear, comprises:

- a stationary internal bell housing secured to the bed on which the handling gear rests, and inside which an upper piston and a lower piston can move in translation between stops formed within the said bell housing, and between the upper piston and the bottom of the said bell housing, respectively;

a mobile external bell housing that can cooperate with the lower piston and to which is secured one of the ends of the handling member, especially a cable or a chain, from the other end of which the load is hung;

an overload pneumatic cylinder which extends between the upper piston and the stationary internal bell housing, and an underload pneumatic cylinder which extends between the upper piston and the lower piston, the cylinders being connected to a source of pressure or exhausted by a series of electric directional control valves.

It consists in actively controlling the pressure within the cylinders continuously so as to alter the datum position of the external bell housing which corresponds to the state of equilibrium as a function of the variations in pressure which are measured at the cylinders in order to cancel out any overload or underload effect on the load, and return the compensator to its state of equilibrium that corresponds to the lifting gear operating in the normal way, that is to say operating in the absence of any overload or underload after the cause which led to such an overload or underload condition has been eliminated.

In other words, the invention consists in permanently and actively controlling the pressure prevailing inside the chambers of the pneumatic cylinders in order to achieve very slight variations in the pressure in the chambers in order to tend towards a constant pressure, with the purpose of maintaining the initial position of the compensation device, and hence of limiting the forces in the event of an overload or of an underload, especially in the event of the fuel assemblies becoming snagged, and also in order to avoid any phenomenon of the load "moving backwards" after the compensation device has come into operation.

According to the invention, as the automatic control is permanent, the stopping of the lifting function in the event of an incident (a grid becoming snagged) is triggered by the detection of a change in position of the compensator, and more precisely of the external bell housing. It is also possible to deduce from this change in position the rate of displacement of the external bell housing, simply by differentiating this change in position with respect to time, the rate being compared with a determined threshold that represents a characteristic of an overload or underload situation, and more specifically of snagging. In fact, using this approach it becomes possible to detect such a situation earlier than the accepted load threshold can be detected by conventional dynamometric means.

In this way, such detection makes it possible very swiftly to trigger the stopping of the movement that led to this situation, and this in fact avoids the drawbacks and disorder inherent in late stopping.

Advantageously, an overload or underload, and more particularly a snagging, detection signal, which works by detecting the overload or underload threshold value and is delivered by a conventional, and especially dynamometric, weighing system is also fed back to cause stopping of the movement that led to this situation, giving the system a degree of redundancy which optimizes the conditions in which such a load compensation device operates.

The invention also relates to the load compensation device that uses this method.

The way in which the invention may be carried out, and the advantages stemming therefrom will become clearer from the embodiment which follows, which is given by way of non-limiting indication supported by the appended figures.

BRIEF DESCRIPTION OF THE DRAWINGS

FIGS. 2 to 4 show various phases in the operation of the load compensation device in accordance with the invention, respectively in equilibrium, in the overload condition and in the underload condition.

Figure 1:
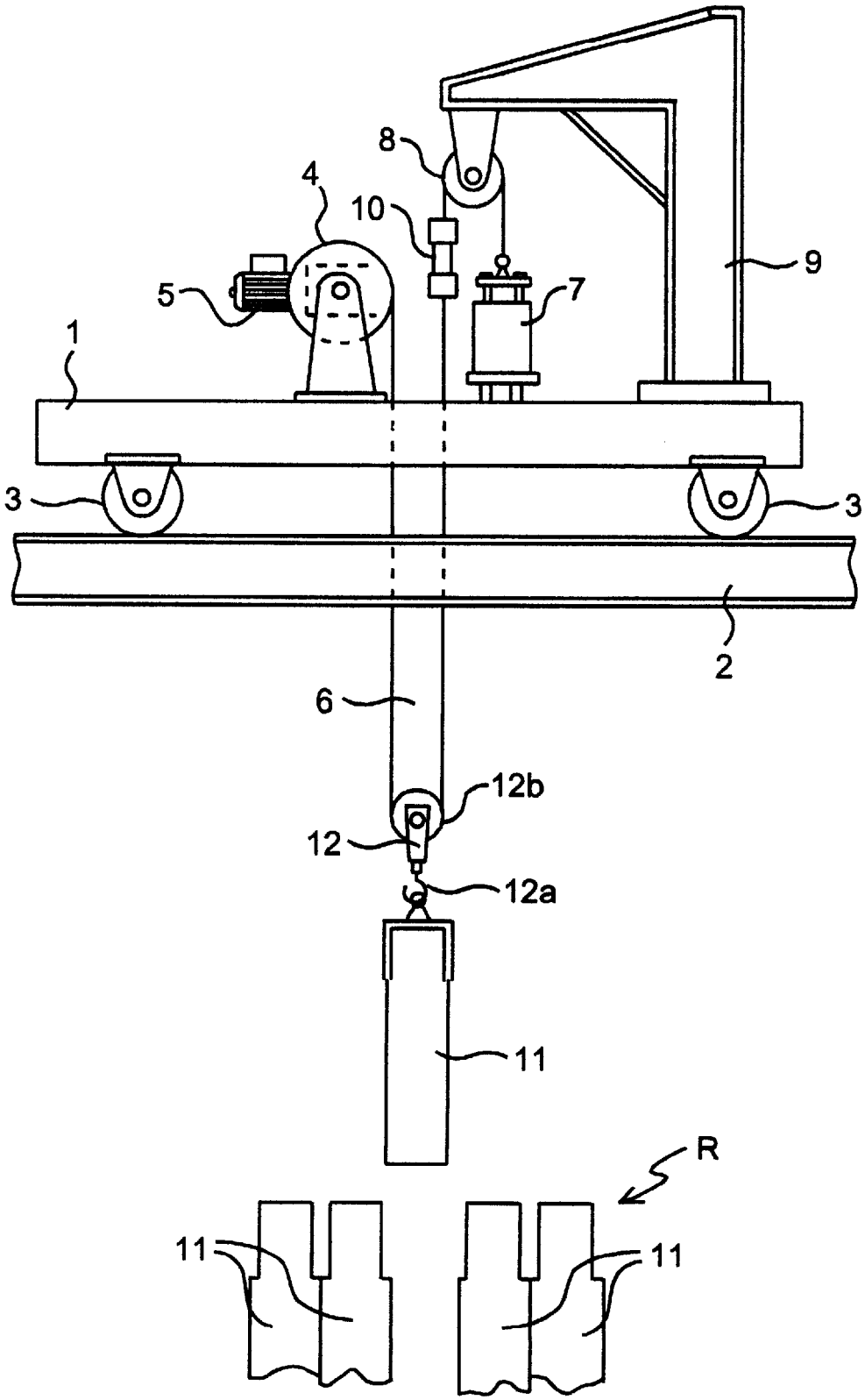
FIG. 1 is a diagrammatic view showing a refuelling machine equipped with the load compensation device in accordance with the invention.

Depicted in FIG. 1 is the truck (1) of a machine for refuelling the reactor of a nuclear power station with nuclear fuel assemblies. This truck moves along a runway path (2) by means of rollers (3), and fixed to it is lifting gear consisting of a winch (4) which is motorized (5) and on which a cable (6) is wound. The other end of the cable (6) is fixed to a load compensation device (7) which is also secured to the truck (1).

The cable (6) runs around a pulley (8) mounted free to rotate on a bracket (9) secured to the truck (1) and it cooperates with a load cell (10) of the dynamometric type with a strain gauge (like the one marketed by TELEMECANIQUE, for example) connected to a weight indicator, the information relating to the weight being transmitted to the programmable automation that manages the refuelling machine.

The load (11) is attached to the hook **(12*a*) of a mobile pulley block (12) around the pulley (12*b*) of which the cable (6) is wrapped before it goes off to wind around the drum of the winch (4)**.

As already stated, the invention is more specifically described in conjunction with the electronuclear industry. In fact, the load (11) in question here consists of a nuclear fuel assembly which needs to be handled within the core of a reactor, it being possible for this handling operation to consist of the installing of the assembly within the core plate, or of its replacement or repositioning.

The load compensator (7) will now be described in greater detail but without going into too much depth, given that this element is quite specifically described in the document EP-B-0,292,413 already mentioned.

This load compensator first of all comprises a stationary internal bell housing secured to the truck (1) and composed of at least two posts **(13*b*) and (13*c*), each of the two posts having two sections (13*b*) and (13*c*) of different diameters, the variation between these sections forming a step (13*a*). The free ends of the two portions (13*c*) are joined together by a crosspiece (14)** that also forms a stop.

An upper piston (15) is capable of moving in translation between the stops **(13*a*) and (14), and a lower piston (16) is also capable of moving between the piston (15)** and more or less the lower end or bottom of the internal bell housing.

Each piston houses a flexible pneumatic cylinder—an overload cylinder (17) and an underload cylinder (18) respectively, FIG. 3 shows the cylinder fed separately by a flexible pipe (24) from a source of compressed air (25).

The connection with the load to be balanced, represented in FIGS. 2 to 4 by an arrow, and which in fact represents the beginning of the cable (6), is achieved via an outer bell housing (19) that can move, therefore in terms of vertical translation, and can press on the base of the lower piston (16) via a ball-type joint (20).

Advantageously, the load to be balanced is connected to a counterweight (21) capable of sliding freely on vertical posts (22) extending from the upper end of the outer bell housing (19) and therefore secured thereto. Note that the displacement of the counterweight (21) on the columns (22) is limited at the top by stops (23).

DESCRIPTION OF THE PREFERRED EMBODIMENT

The compensator (7) works as follows.

When the system is in equilibrium (see FIG. 2, that is to say when the load encounters no obstacles, the respective pressures in the cylinders (17) and (18) are $PU_1$ and $PO_1$ respectively. The pressure $PO_1$ is fixed in such a way that it cannot cause the upper piston (15) to move, and so that this piston in fact rests against the stops (13*a*) formed on the internal bell housing (13).

This equilibrium is sustained as long as the tension in the cable remains more or less constant, and especially as long as it does not exceed a determined threshold. In fact, the external bell housing is at a height h with respect to the base of the internal bell housing, as represented in FIG. 2.

In the event of an overload (FIG. 3), the additional tension is damped by the load compensator by causing the external bell housing (19) to move upwards by a height $h_1$, by reducing the pressure inside the overload cylinder to a new value $PU_2$ which is lower than $PU_1$.

Similarly, in the event of an underload (FIG. 4), the reduction in tension of the cable is damped and the tension is thus kept in equilibrium by lowering the external bell housing by causing a pressure $PO_2$ inside the underload cylinder which is higher than $PO_1$.

As already mentioned, the load compensator known from the prior art worked off overload or underload detection thresholds, these detection thresholds being detected by the load cell (10).

The drawbacks associated with this way of operating of the compensator have also been demonstrated.

In actual fact, and in accordance with the invention, each of the chambers of the pneumatic cylinders—the overload cylinder (17) and the underload cylinder (18) respectively—is fitted with a pressure sensor (29) capable permanently of indicating the pressure prevailing inside these chambers, and the measured data from which is transferred to the programmable automation (27) already mentioned which acts on a series of electric directional control valves (30) which let in source of compressed air from pressure source (25) or exhaust through vacuum (26).

In actual fact, in the event of an overload, the pressure detected within the overload cylinder (17) will increase on account, on the one hand, of the fact that the volume of the cylinder cannot expand and, on the other hand, of the overtension transmitted through the cable (6) and relayed by the external bell housing (19).

This overpressure is immediately discharged from one or both chambers simultaneously until the equilibrium pressure is regained, that is to say with a view to maintaining the same pressure as there was in the state of equilibrium, while at the same time seeing the external bell housing rise from the height h to the height h1.

In other words, the internal pressure sensor associated with its operating automation will simply bring the excess pressure inherent in overload back to the original pressure that prevailed when the compensator was in the position of equilibrium.

Conversely in the event of an underload, there will be a reduction in the tension in the cable and hence a tendency for the external bell housing (19) to fall so that the pressure inside the pneumatic chamber of the underload cylinder (18) will drop and, at the same time, bearing in mind the automation, this reduction will be compensated for by the introduction of compressed air until the initial equilibrium pressure is regained. At the same time, the external bell housing will drop from the height h to the height $h_2$ until the compensator returns to the conditions of equilibrium.

In other words, this regulation of pressure which furthermore can be modulated simultaneously at one or both chambers will cause the variation in force at the cable to be minimized and will furthermore keep the elements involved, especially the fuel assemblies, in physical contact.

Furthermore, because the forces exerted on the cable, especially the tension, are kept almost constant, and also because of the continuous variations in pressure employed, the moving backwards phenomena which are observed when the compensator works using pressure thresholds are avoided.

According to the invention, the installation is fitted with sensors (31) for detecting the position of the load compensator, and more specifically for detecting the position of the external bell housing (19).

These position sensors are sensors that are known per se, especially using technology of the optical or differential transformer type, which will take measurements for automatically controlling the position of the external bell housing. The corresponding signals are furthermore processed in order to determine, by differentiating with respect to time the distance thus measured through which the bell housing has been displaced, the rate of this displacement. This rate is characteristic of an overload or underload, and more specifically of a snagging, situation, and determining it makes it possible very swiftly to trigger the stopping of the winch (4), that is to say the stopping of the movement which led to this situation.

According to an advantageous feature of the invention, an overload, underload, and more specifically snagging, detection signal, which works by detecting the value of the overload or underload threshold delivered by the load cell (10), is also fed back to the programmable automation (27) giving the system a degree of redundancy that optimizes the conditions in which such a load compensation device works.

The method of operation and of regulation of the load compensation device in accordance with the invention has a number of consequences and confers a number of advantages, among which the following may be mentioned:

- keeping the cylinders at a constant pressure leads to a force existing during overload or underload conditions which is close to the force that exists in the equilibrium condition;
- keeping the cylinders at constant pressure, with a slight variation in the force resulting therefrom, makes sure that the cable and the load remain in contact, without any reverse-movement phenomena, which means that there is no longer reverse interference between the spacer grids of fuel assemblies of different types;
- the continuity of the pressure regulation leads to the absence of jerkiness;
- control over the position of the compensator allows the latter to be returned to its initial position after the snagging effect has been eliminated;
- the flexibility and accuracy of this system make it possible to reduce the detection thresholds to lower values, typically 40 to 60 daN instead of 80 daN.

I claim:

1. A method of regulating the operation of a load compensation device for overloads and underloads of a handling gear, wherein the load compensation device is attached at an upper end to a cable holding a load via a pulley, a stationary internal bell housing being secured onto a truck on which the handling gear rests, an upper piston being located within the stationary housing and movable between two stops, a lower piston being movable between a bottom surface of the upper piston and a base end of the stationary internal bell housing, a vertically-movable external bell housing attached at a lower end to a ball joint that presses on the bottom surface of the lower piston, an overload pneumatic cylinder housed within the upper piston and extendable between a base surface of the upper piston and a stop in the stationary internal bell housing, an underload pneumatic cylinder housed within the lower piston and extendable between a bottom surface of the upper piston and a base surface of the lower piston, and both pneumatic cylinders communicating with a pressure source and exhausted by a plurality of electric direction control valves, the regulating method comprising:

controlling the pressure within the overload pneumatic cylinder and the underload pneumatic cylinder of the load compensator to alter a datum position of the external bell housing to a position corresponding to a revised state of equilibrium;

measuring a variation in the pressure in each of the overload and underload pneumatic cylinders used to alter the datum position of the external bell housing to a revised state of equilibrium; and adjusting the pressure within the overload and underload pneumatic cylinders by an amount proportioned to the measured variation in pressure to restore the datum position of the external bell housing back to an initial state of equilibrium prior to the occurrence of one of an underload or an overload condition;

wherein controlling the pressure includes detecting a change in pressure in the overload and underload pneumatic cylinders and a rate of displacement of the external bell housing is differentiated with respect to time by comparing the rate of displacement of the external bell housing with predetermined values that correspond to one of an overload and an underload condition to stop the handling gear from movement; and wherein differentiating the rate of displacement of the external bell housing includes utilizing a position sensor within said external bell housing.

2. A load compensation device for a handling gear comprising:

a stationary internal bell housing attached to the base of a truck on which a handling gear rests;

an upper piston located within an upper portion of said stationary internal bell housing and movable between a pair of upper and lower stops;

a lower piston located in a lower portion of said stationary bell housing and movable between a bottom surface of the upper piston and a base end of said stationary internal bell housing;

a vertically-movable external bell housing attached at a lower end to a ball joint that presses on the bottom of the lower piston;

a handling member attached at one end to said vertically-movable external bell housing and at another end to a load;

an overload pneumatic cylinder housed within said upper piston and an upper stop in said stationary internal bell housing;

an underload pneumatic cylinder housed with said lower piston and extendable between a bottom surface of the upper piston and a base surface of the lower piston;

pressure sensors located within each of said overload pneumatic cylinder and said underload pneumatic cylinder; and a programmable automation that receives a signal from each of said pressure sensors;

a pressure source connected to said overload pneumatic cylinder and to said underload pneumatic cylinder;

an exhaust source connected to said overload pneumatic cylinder and to said underload pneumatic cylinder;

a plurality of electric directional control valves connected in line with said pressure source and said exhaust source, respectively;

said plurality of electric directional control valves being actuable by said programmable automation based on signals received from each of said pressure sensors.

3. A load compensation device according to claim 2 further comprising:

a position sensor located within said external bell housing to detect displacement of said external bell housing to determine a rate of displacement of said external bell housing with respect to time, said programmable automation connected to receive a signal from said position sensor and calculate a rate of displacement that is compared with predetermined values of rate displacement stored in said programmable automation representing overload and underload conditions.

4. A load compensation device according to claim 3, wherein said programmable automation comprises means for continually monitoring and controlling the pressure within the pneumatic cylinders.

* * * * *